United States Patent [19]

Tivelius

[11] Patent Number: 4,460,164

[45] Date of Patent: Jul. 17, 1984

[54] APPARATUS FOR REFINING OF STEEL MELTS

[75] Inventor: Bertil G. Tivelius, Viken, Sweden

[73] Assignee: Scandinavian Lancers Aktiebolag, Hoganas, Sweden

[21] Appl. No.: 467,901

[22] Filed: Feb. 18, 1983

Related U.S. Application Data

[62] Division of Ser. No. 367,796, Apr. 12, 1982.

[51] Int. Cl.[3] ..... C21B 7/22

[52] U.S. Cl. ..... 266/158; 75/49; 75/61

[58] Field of Search ..... 75/49, 61; 266/158

[56] References Cited

U.S. PATENT DOCUMENTS 4,200,452 4/1980 Savov ..... 75/49

*Primary Examiner*—Peter D. Rosenberg

*Attorney, Agent, or Firm*—Murray and Whisenhunt

[57] ABSTRACT

Apparatus for treating molten metal comprising a ladle for containing a molten metal to be treated having an upper edge, a hood arranged above the ladle and comprising a heat shield essentially covering completely the ladle and having a ceramic lining facing the molten metal in the ladle, with the heat shield and the upper edge of the ladle being spaced from each to define a gap between the heat shield and the upper edge of the ladle. A screen forms and all-enveloping roof over the heat shield and extends over and below the gap to define a circumferential opening between the screen and the ladle below the gap, and spacing means extending between the screen and the heat shield are provided for maintaining the screen and the heat shield spaced apart with respect to each other to define a chamber between the screen and heat shield. The gap communicates with the chamber for the passage of gases therethrough from the ladle to the chamber, and the circumferential opening defines an inlet opening for ambient air to the chamber. At least one lance means is provided for introducing at least one gas in the molten metal in the ladle and/or to a ladle area above the molten metal, and at least one exhaust means communicating with the chamber is provided for exhausting gases which pass from the ladle area above the molten metal into the chamber through the gap, and also for exhausting air which is sucked from the ambient atmosphere into the chamber mainly through the circumferential opening. At least one aperture means is provided in the hood for lowering at least one of the lance means into the ladle.

8 Claims, 1 Drawing Figure

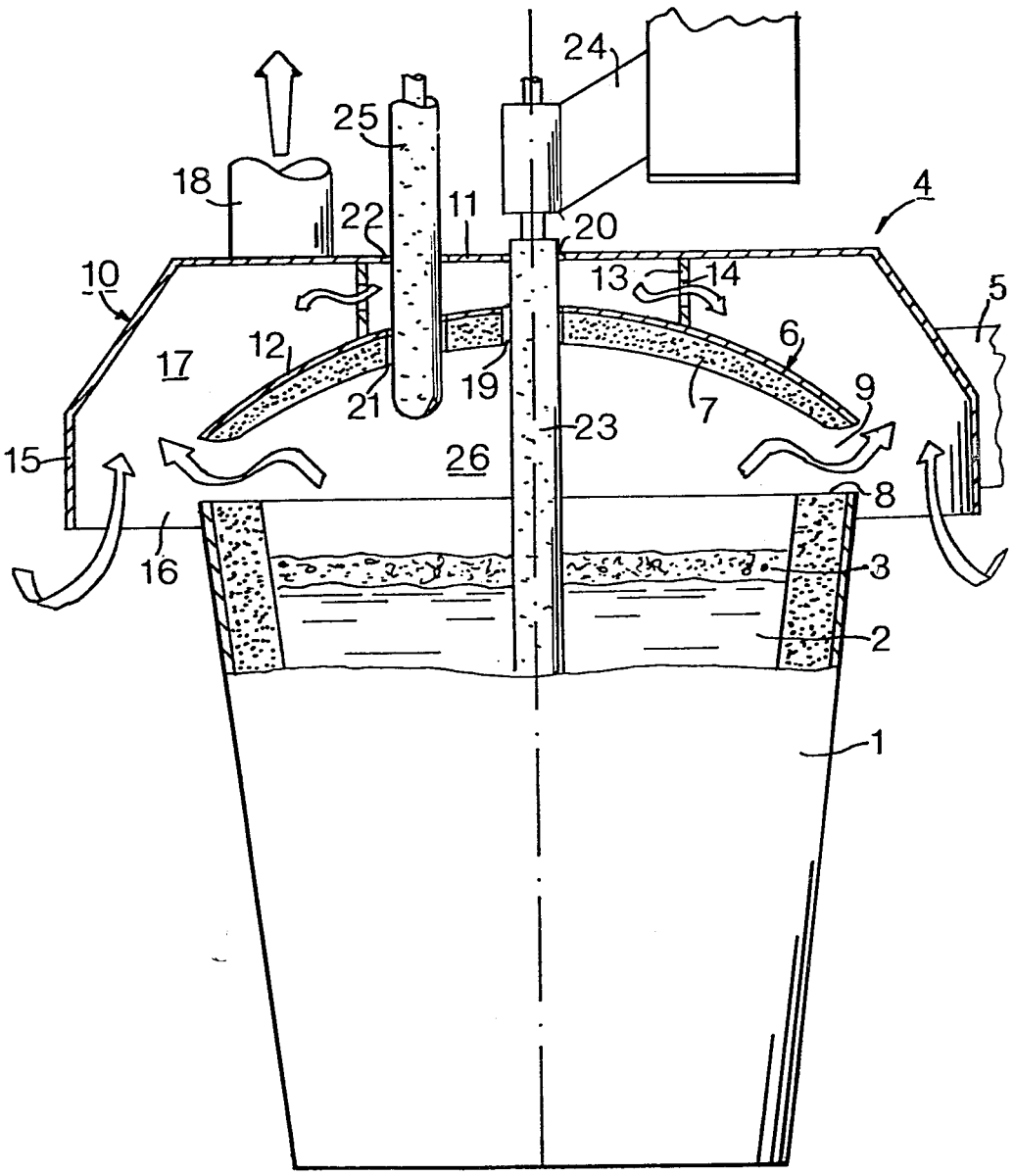
24
25
18
22
11
20
4
10
13
14
5
17
12
6
19
21
7
9
23
15
26
8
16
3
2
1

APPARATUS FOR REFINING OF STEEL MELTS

This is a divisional application of Ser. No. 367,796, filed Apr. 12, 1982.

TECHNICAL FIELD

The invention relates to a method for refining steel melts for the production of steel, especially stainless steel, with extremely low oxygen content. More precisely the invention relates to an injection metallurgical method for reducing the oxygen content in steel melts to extremely low levels. The invention also relates to equipment for carrying out the method.

BACKGROUND OF THE INVENTION

In the metallurgy of steel, injection technique is playing an increasingly important role for the development of continuously improved steel qualities. By injecting fine particle size calcium and/or magnesium compounds or alloys it has thus for example been possible to reduce the total content of sulphur in steel melts to extremely low values. By selecting suitable injection products it has also been possible to transform residual sulphides so that these become as harmless as possible. For example U.S. Pat. No. 4,261,735 describes a method in accordance with which lime, CaO, is initially injected and then when the majority of the sulphur has been removed, injection is continued with calcium-silicon, SiCa, calcium carbide, $CaC_2$, and/or calcium cyanamide, $CaCN_2$.

In modern metallurgy it has also been possible to reduce the content of oxidic inclusions to very low levels. Traditionally the majority of the oxygen in steel melts is removed by de-oxidation using a suitable de-oxidising agent, usually aluminium, silicon or manganese. To reduce the oxygen content to values lower than those which can be achieved using aluminium, silicon and manganese it is necessary however to employ more effective oxidising agents. The substances which can be mainly considered are alkaline earth metals in the elementary or non-oxidic-combined form. In actual practice this usually signifies calcium, although also magnesium can be employed as an alternative to calcium. For example calcium can be added in metallic form, as a wire encapsulated in a plate metal casing. Calcium can also be added as calcium-silicon, although the maximum permissible silicon content in the steel imposes a limit on how much calcium-silicon can be added. Furthermore in actual practice it has proved difficult to reduce the oxygen content in this way. The same applies to the injection of calcium carbide $CaC_2$, which in addition signifies that the melt is carburised and this is not acceptable in many cases, particularly not when producing low carbon content stainless steel or other steels with very low carbon content.

In the search for increasingly improved grades of steel requirements have now been imposed for extremely low oxygen contents, meaning not more than 5 ppm and preferably not more than 2 ppm dissolved oxygen in the liquid steel after the injection treatment. The aim of these extremely low oxygen contents is to reduce the total quantity of oxidic inclusions in the finished steel. By reducing the content of oxidic inclusions, mainly inclusions of the $Al_2O_3$ type, it is thus possible to considerably reduce the number of rupture initiators. Furthermore the polishability of the steel can be improved which in many cases is a desireable property for stainless steel and tool steels. The low oxygen content also has advantages from the viewpoint of the matallurgical process, because a low content of oxidic inclusions improves the viscosity of the steel and reduces the risk of blockages during the casting of the steel. Furthermore a low oxygen content is a pre-requisite if extremely low sulphur contents are also to be achieved, because the oxygen activity in the steel melt determines the course of desulphurisation.

The extremely low oxygen contents required in accordance with the invention, i.e. not more than 5 ppm and preferably not more than 2 ppm, could not however be achieved at reasonable cost with high reproducibility using methods known hitherto unless at the same time quality requirements other than the low oxygen content were abandoned.

DISCLOSURE OF THE INVENTION

The aim of the invention is to provide a method, with high economy and good reproducibility, of refining steel melts for the production of steel, particularly stainless steel with extremely low oxygen content, i.e. not more than 5 ppm and preferably not more than 2 ppm in the molten steel. In accordance with the invention different alkaline earth metal compounds or alloys, preferably calcium compounds or alloys, are injected in one or several sequences. Each such sequence comprises the injection of calcium-silicon, SiCa, in the form of powder by means of a non-oxidising carrier gas, whereby silicon is dissolved into the melt whilst at least a significant portion of the calcium is oxidised by the oxygen to form small particles of calcium oxide, CaO, of which some are separated to the slag cover whilst the remainder of the calcium stays behind in the melt in elementary form or combined in the form of particulate calcium oxide in colloidal solution. Preferably the amount of SiCa injected is such that by this means the content of dissolved oxygen in the melt is reduced to at least half. Then powdered calcium oxide, CaO alone or, preferably, together with fluorspar, $CaF_2$, is injected whereby these latter larger CaO particles function as nucleus forming agents for the continued reaction between calcium and oxygen dissolved in the melt, and also for separating smaller inclusions already present in the melt to the slag covering.

The method described of injecting SiCa followed by injection of CaO can be repeated once or several times so as to further reduce the oxygen content in the melt during each sequence.

Simultaneous with the injection of CaO it is also possible to add other calcium compounds such as $CaF_2$. A conceivable $CaF_2$ content in the combined CaO and $CaF_2$ addition is 10–30 weight %, suitably about 20%. It is also possible to envisage the addition of other non-oxidic-bound calcium compounds, e.g. calcium carbide $CaC_2$ and/or calcium-cyanamide, $CaCN_2$, during the injection of calcium-silicon, SiCa. Instead of calcium compounds in the sequence described above it is also possible to envisage the use of magnesium compounds of the corresponding type.

It should also be mentioned that prior to the injection of the said compounds the steel melt must be de-oxidised and covered by a basic, reduced slag in a metallurgical ladle. Conventional deoxidising agents such as aluminium, silicon or manganese can be used for de-oxidation, and known reducing agents such as aluminium and silicon can also be employed for reduction. For example it can be appropriate to use silicon in the form of calcium-silicon, SiCa, whereby the simultaneous admixture of SiCa can represent the first stage of the sequence of injections in accordance with the invention.

To permit rapid change overs from one substrate to another during the sequential injection of the said compounds it may be appropriate to make use of for example the method employing two or more series-connected powder emitters as described in U.S. Pat. No. 3,998,625.

It should also be mentioned that apart from oxygen reduction very efficient sulphur refining is also achieved, in that some of the calcium in the injected calcium-silicon combines with the sulphur dissolved in the melt, after which the calcium sulphide formed collects in the slag cover. Also the injected calcium oxide, like the calcium oxide formed in situ in the melt, can contribute in a corresponding manner towards reducing the sulphur content, especially if the oxygen in the melt is approaching extremely low values. Actually an injection of calcium oxide undertaken in accordance with a conventional method should result in a reduced sulphur content, whilst on the other hand the oxygen content would not be further reduced. In the case of the procedure in accordance with the invention however as a result of the sequence selected at the same time a continued reduction of oxygen is obtained during the injection of CaO.

In the method use is made of a wholly or partially basic-lined ladle. The ladle can for example be lined with dolomite. The equipment in accordance with the invention also comprises a hood which during refining is placed above the ladle. The hood contains firstly a heat shield which essentially covers the ladle, although a gap is left between the heat shield and the upper edge of the ladle. A screen extends across and below the said gap so that a circumferential opening is formed between the screen and the ladle below the said gap. Furthermore at least one exhaust pipe is provided to communicate with the space underneath the said screen to suck out exhaust gases which pass from the ladle chamber out into the said space through the said gap, and also air which flows in from the ambient atmosphere through the opening between the screen and the outside of the ladle. Furthermore at least one aperture is provided in the hood for at least one lance which can be lowered into the space underneath the heat shield and/or into the melt in the ladle.

In accordance with a preferred embodiment the screen forms an all-closing roof over the heat shield, where the said aperture or apertures also extend through the screen over the heat shield, and where the entire space between the screen and the heat shield is so arranged as to be ventilated by sucking out through the said exhaust pipe. The equipment can be designed for two lances, namely an injection lance and a gas purging lance, arranged so that they can be introduced simultaneously into the ladle chamber under the heat shield through two apertures in the hood. One lance aperture is appropriately arranged centrally whilst the other aperture is displaced to the side.

DESCRIPTION OF THE PREFERRED EMBODIMENT

A detailed description with reference to the appended drawings which show a section through a ladle with a hood in accordance with the invention will now be given of a preferred embodiment of the equipment in accordance with the invention. The ladle has been generally designated as 1, a steel melt by 2 and a slag cover by 3. Above the ladle 1 a hood generally designated as 4 is provided. The hood 4 can rest, with the support provided for the purpose, on the upper edge of the ladle 1 or be kept in place by means of an arm 5 which can be raised, lowered and pivoted. As a third alternative the hood can be suspended in chains beneath a platform. The hood 4 consists of a heat shield 6 with ceramic lining which faces the slag cover 3. A gap between the heat shield 6 and the upper edge 8 of the ladle is designated as 9.

Above the heat shield 6 a screen 10 is provided having a central section 11 which is joined to the upper steel casing 12 of the heat shield by a circular intermediate wall 13 with apertures 14. From the central section 11 the screen 10 extends, by way of a peripheral section 15 beyond the edge 8 of the ladle 1 and down past the gap 9 to a level underneath the edge 8. The opening between the projecting portion of screen 10 and the outside of ladle 1 is designated as 16, whilst the space between the shield 6 and the screen 10 is designated as 17. An exhaust pipe 18 is connected to the space 17.

The heat shield 6 and the screen 10 are provided with two pairs of concentric apertures 19, 20 and 21, 22. The two first mentioned apertures 19, 20 are arranged centrally and are designed for an injection lance 23 with a lance manupulator 24, whilst the two other apertures 21, 22 are arranged at the side thereof and designed for a gas purging lance 25. Both lances 23 and 25 can be brought down into and up from the melt 2. The gas purging lance 25 can also be introduced into the ladle chamber underneath the heat shield 6 without being introduced into the melt 2. During operation, whether the gas purging lance 25 is immersed in the melt or not, inert gas is supplied under pressure above atmospheric pressure to the ladle chamber 26 between the heat shield 6 and the slag covering 3. The inert gas is supplied to the said space through the injection lance 23 and/or through the gas purging lance 25. The gases flow out through the gap 9 to the space 17 which is kept under vacuum in comparison with the ambient atmosphere by means of exhaustion through pipeline 18. At the same time a certain amount of air flows in through the opening 16, which air is mixed with the gases in the space 17 and is withdrawn together with the gases through pipeline 18, thus preventing any noticeable quantities of air flowing into the ladle chamber 26. By keeping the space 17 under vacuum, (reduced-pressure) with reference to the ambient atmosphere, it is also ensured that no considerable quantities of air flow into the ladle chamber 26 through the lance apertures 19–22.

I claim:

1. Apparatus for treating molten metal, said apparatus comprising:

a ladle for containing a molten metal to be treated, said ladle having an upper edge;

a hood arranged above said ladle, said hood comprising a heat shield essentially covering completely said ladle and having a ceramic lining facing said molten metal in said ladle, said heat shield and said upper edge of said ladle being spaced from each other to define a gap between said heat shield and said upper edge of said ladle;

a screen forming an all-enveloping roof over said heat shield and extending over and below said gap to define a circumferential opening between said screen and said ladle below said gap;

spacing means extending between said screen and said heat shield for maintaining said screen and said heat shield spaced apart with respect to each other to define a chamber between said screen and said heat shield, said gap communicating with said chamber for passage of gases from said ladle through said gap to said chamber, said circumferential opening defining an inlet opening for ambient air to said chamber;

at least one lance means for introducing at least one gas into said molten metal in said ladle and/or to a ladle area above said molten metal;

at least one exhaust means communicating with said chamber for exhausting gases which pass from said ladle area above said molten metal into said chamber through said gap, and also for exhausting air which is sucked from ambient atmosphere into said chamber mainly through said circumferential opening; and at least one aperture means provided in said hood for lowering at least one said lance means into said ladle.

2. Apparatus according to claim 1 wherein said at least one aperture also extends through said screen above said heat shield, and all space between said screen and said heat shield is arranged to be ventilated by exhaustion through said exhaust means.

3. Apparatus according to claim 2 wherein an injection lance and a gas purging lance can be introduced simultaneously into a ladle space under said heat shield through two lance apertures extending through said hood.

4. Apparatus according to claim 3, wherein one lance aperture is arranged centrally in said hood, and the other lance aperture is displaced towards a side of said hood.

5. Apparatus according to claim 1, 2, 3, or 4, and further including inert gas means for maintaining an inert gas overpressure in said ladle area above said molten metal during injection and thereafter prior to casting.

6. Apparatus according to claim 5 and further including vacuum means for maintaining a vacuum in said chamber.

7. Apparatus according to claim 1, wherein said aperture means are provided in said hood for lowering at least one said lance means into a ladle space under said heat shield.

8. Apparatus according to claim 1, wherein said aperture means is provided in said hood for lowering at least one said lance means into said molten metal in said ladle.

* * * * *